United States Patent [19]

Mueller et al.

[11] 4,447,273

[45] May 8, 1984

[54] PROCESS FOR PHOSPHATING METALLIC SURFACES IN NONAQUEOUS PHOSPHATING BATHS

[75] Inventors: Dieter J. Mueller; Hermann Fricke; Heinrich Spielbrink, all of Marl, Fed. Rep. of Germany

[73] Assignee: Chemische Werke Huels Aktiengesellschaft, Marl, Fed. Rep. of Germany

[21] Appl. No.: 475,798

[22] Filed: Mar. 16, 1983

[30] Foreign Application Priority Data

Mar. 18, 1982 [DE] Fed. Rep. of Germany ..... 3209828

[51] Int. Cl.[3] ..... C23F 7/10

[52] U.S. Cl. ..... 148/6.15 R

[58] Field of Search ..... 148/6.15 R

[56] References Cited

U.S. PATENT DOCUMENTS

| | | | |
|---|---|---|---|
| 2,854,370 | 9/1958 | Kronstein | 148/6.15 R |
| 2,992,146 | 7/1961 | Low | 148/6.15 R |

FOREIGN PATENT DOCUMENTS

| | | | |
|---|---|---|---|
| 607061 | 10/1960 | Canada | 148/6.15 R |
| 690340 | 7/1964 | Canada | 148/6.15 P |

*Primary Examiner*—Sam Silverberg

*Attorney, Agent, or Firm*—Millen & White

[57] ABSTRACT

A process for phosphating metallic surfaces in nonaqueous phosphating baths comprising low-boiling halogenated hydrocarbons, aqueous phosphoric acid as the phosphating agent, alcohols as the solubilizer, and, optionally, further known components, e.g., stabilizers, inhibitors, or accelerators, comprising dipping the workpieces to be phosphated at least twice for at least 10 seconds into the boiling phosphating bath and, in the interval, leaving them for at least 20 seconds in the gaseous phase.

20 Claims, No Drawings

PROCESS FOR PHOSPHATING METALLIC SURFACES IN NONAQUEOUS PHOSPHATING BATHS

BACKGROUND OF THE INVENTION

The present invention relates to the technique of phosphating metallic surfaces in nonaqueous phosphating baths.

It is known from experience with the conventional phosphating process (see W. Rausch, "Die Phosphatierung von Metallen" [The Phosphating of Metals], Eugen G. Leuze Publishers, Saulgau (1974), page 103), using conventional aqueous phosphating baths based on the ammonium or alkali dihydrogen phosphates—the so-called Fe phosphating process—that phosphate layer thicknesses of 0.3 μm up to about 0.8 μm are attainable by dipping methods, depending upon the choice of a dipping time in the range of about 2–5 minutes. An extension of the dipping period past this time does not result in a thickening of the phosphate layer. Only single-dip processes are known.

Also in the conventional, phosphating method (see W. Rausch, "Die Phosphatierung von Metallan", Eugen G. Leuze Publishers, Saulgau (1974), page 42) based on aqueous zinc phosphate, zinc iron phosphate, or zinc calcium phosphate solutions—the so-called Zn phosphating process—only the one-time dipping of the article to be phosphated has been used. In this process, phosphate layer thicknesses of about 1 μm to about 20 μm are produced, depending on the usage application, using dipping periods of 5–10 minutes or by spraying methods; layer thicknesses of about 2 μm to 3 μm are preferred.

Also, for the phosphating methods based on organic solvents—the so-called solvent phosphating process—especially those based on low-boiling halogenated hydrocarbons, which have become increasingly popular in recent years, only one-time dipping processes have been disclosed. In this connection, the dipping period is normally 0.5–3 minutes, reaching, in general, layer thicknesses of 0.1 μm to about 1 μm, depending on the dipping time and the composition of the organic phosphating bath. In individual cases, larger layer thicknesses are also attainable.

In order to evaluate the quality of phosphate layers on metallic surfaces as corrosion protection and/or as inorganic primer coatings for subsequent varnishing, the layer thickness alone is not an adequate criterion; rather, decisive factors also include porosity, surface roughness, crystallinity, water solubility, adhesive strength with respect to the metal surface, adhesiveness to the varnish coat, and other surface-specific properties. Only the combined effects of all surface and layer properties can determine the corrosion protection and the suitability as primer coatings.

For the evaluation of phosphate layers, empirical testing methods are generally employed after a distinct varnish coating step, such as, for example, the salt spray mist test on scratched test panels according to DIN [German Industrial Standard] 50 021 and DIN 53 167; the criss-cross cutting test according to DIN 53 151; the determination of the extent of rusting according to DIN 53 210; the determination of the degree of blistering (pimpling) according to DIN 53 209; and other test methods based on a given application.

The use of such testing methods for conventionally Fe-phosphated surfaces shows that the aqueous Fe-phosphating offers only a minor corrosion protection. In many cases, the requirements to be met by utilitarian articles and/or technical components are not satisfied.

In such cases, the conventional Zn-phosphating method is presently customarily employed, yielding a significantly better corrosion protection. However, Zn-phosphating, as compared with Fe-phosphating, is considerably less economical and represents a greater threat to the environment due to increased sludge formation.

In the more recent phosphating methods based on organic solvents, especially those based on low-boiling halogenated hydrocarbons, such as described, for example, in DAS 2,611,789, DAS 2,611,790, or European Patent Application 34,842, phosphating reactions similar to those of aqueous Fe-phosphating reactions are involved. Therefore the quality of the phosphate layers corresponds essentially to the quality of the conventional Fe-phosphating process. In many instances, therefore, the phosphate layers from the solvent phosphating process, just as the phosphate layers obtained by the conventional Fe-phosphating method, do not meet the posed requirements.

As is known, the solvent phosphating procedure, however, offers considerable advantages as compared with the conventional aqueous phosphating processes. For example, there is no environmental pollution by wastewater; the number of treatment steps is lower due to the elimination of various washing and rinsing steps; and the furnace drying step, which requires a large amount of energy, is unnecessary.

SUMMARY OF THE INVENTION

Accordingly, it is an object of this invention to provide a solvent phosphating method preserving the well-known advantages of solvent phosphating and simultaneously yielding phosphate layers satisfying the higher requirements, as have usually only been met by Zn-phosphating.

Upon further study of the specification and appended claims, further objects and advantages of this invention will become apparent to those skilled in the art.

These objects have been achieved by providing a process for phosphating metallic surfaces in nonaqueous phosphating baths which comprise low-boiling halogenated hydrocarbons, aqueous phosphoric acid as the phosphating agent, an alcohol as the solubilizer, and, optionally, additional conventional components including stabilizers, inhibitors, or accelerators comprising dipping the workpieces to be phosphated, after they have been preheated, usually in the gas phase, at least twice for at least 10 seconds each time into the boiling phosphating bath and in the interval, leaving them for at least 20 seconds in the gaseous phase of the boiling bath.

DETAILED DESCRIPTION

It has been found that, in contrast to the aqueous phosphating procedure, multiple dipping in the case of solvent phosphating leads to a marked improvement in corrosion-protective properties. Multiple dipping with specific dipping periods in the liquid phase and intervening intervals, adapted thereto, of suspending the workpiece in the gaseous phase above the liquid phase yields better results than a single dipping, even if the total dipping period is of the same length. It is especially advantageous for the process of this invention if the liquid phase contains surface-activating components with high vapor pressure, such as, for example, formic acid esters, which also enter the gaseous phase and become effective in the latter as disclosed fully in related, commonly assigned application Serial No. (Attorney Docket No. Huels 539), filed on even date, whose disclosure is incorporated by reference herein.

A typical phosphating procedure takes place as follows according to the process of this invention:

The cleansed, previously degreased workpiece is first suspended in the gaseous phase directly above the slightly boiling phosphating bath liquor. The slightly boiling condition is not critical but merely implies a rate of boiling is to be chosen to provide convenient process controlability. Condensate runoff occurs until the workpiece has reached the temperature of the gaseous phase. This can take various lengths of time, depending on the thermal capacity of the workpiece. Thereafter, the workpiece is dipped for about 10–60 seconds, preferably 20–30 seconds, into the boiling phosphating bath. It is then lifted up into the gaseous phase, and left suspended therein for about 20–120 seconds, preferably 30–90 seconds. Longer dipping periods and intervals are possible, but do not improve the result. This cycle is repeated at least once, preferably twice, optionally more frequently. The total dipping period is preferably 30–90 seconds, especially preferably 30–60 seconds.

This phosphating technique therefore requires phosphating with a boiling phosphating bath exhibiting an adequately large vapor space above the liquid phase. Consequently, the process of this invention relates preferably to phosphating baths of a low boiling point of, for example, about 40° C., as is the case with phosphating baths based on dichloromethane as the primary solvent.

Other low-boiling halogenated hydrocarbons suitable as the primary solvent include: dichloromethane, chloroform, trichlorofluoromethane, dichloroethane, trichloroethylene, 1,1,1-trichloroethane, 1,1,3-trichlorotrifluoroethane, or a mixture thereof.

Suitable low-boiling alcohols usable as solubilizers include: methanol, ethanol, propanol, isopropanol, butanol, sec-butanol, tert-butanol, and mixtures thereof. It is also possible to employ higher homologs, such as n-pentanol, sec-pentanol, n-hexanol, sec-hexanol, isohexanol, heptanol, n-octanol, 2-ethylhexanol, nonanol, decanol, undecanol, dodecanol, or mixtures thereof.

Stabilizers optionally usuable include: quinones, phenols, nitrophenols, nitromethane, and other customary stabilizers for halogenated, e.g., chlorinated hydrocarbons.

The following compounds are suitable, optionally, as phosphating regulators as well as bath stabilizers: urea, dimethylurea, diethylurea, nitrourea, thiourea methylthiourea, ethylthiourea, dimethylthiourea, diethylthiourea, and other alkylated ureas and thioureas.

The following compounds can optionally be employed as accelerators: nitrobenzene, dinitrobenzene, nitrotoluene, dinitrotoluene, nitroethylbenzene, pyridine, picric acid, and mixtures thereof.

The primary solvent will generally be used in an amount of 60–85% by weight, preferably 70–80% by weight, based on the entire phosphating bath, while the aqueous phosphoric acid should be used in a quantity such that a $H_3PO_4$ concentration of 0.1–2.0% by weight, preferably 0.3–1.0% by weight is present, based on the entire phosphating bath. The concentration of the water in the phosphating bath should be 0.5–7% by weight, preferably 3.0–6.0% by weight.

Methanol or a mixture of alcohols with a predominant proportion of methanol usually serves as the solubilizer. The concentration of the methanol or of the alcohol mixture with predominant methanol proportion, or of alcohol in general, should be 10–30% by weight, preferably 15–25% by weight, based on the entire phosphating bath.

The accelerators, stabilizers, and inhibitors can each be present in a concentration of 0.01–1.0% by weight, preferably 0.05–0.3% by weight, based on the entire phosphating bath.

The formic acid ester of this invention of the mentioned commonly assigned application can be included in a concentration of 0.01–2.0% by weight, preferably 0.1–1.0 by weight, based on the entire phosphating bath. Formic acid methyl ester is preferably used as the formic acid ester, but it is likewise possible to use formic acid ethyl ester, propyl ester, isopropyl ester, butyl ester, sec-butyl ester, tert-butyl ester, and mixtures thereof. Also, higher homologous formic acid esters can be employed, such as, for example, formic acid pentyl ester, sec-pentyl ester, isopentyl ester, n-hexyl ester, sec-hexyl ester, isohexyl ester, heptyl ester, n-octyl ester, 2-ethylhexyl ester, nonyl ester, decyl ester, undecyl ester, dodecyl ester, or mixtures thereof. The formic acid esters can thus contain 1–12 carbon atoms in the alcohol portion.

Typical formulations of phosphating baths based on low-boiling halogenated hydrocarbons include the following (percentages are weight percentages in all cases):

I

74% $CH_2Cl_2$, 20% $CH_3OH$, 5% $H_2O$, 0.7% $H_3PO_4$, 0.1% 2,4-dinitrotoluene, 0.1% urea, 0.3% $HCOOCH_3$

II

73% $CH_2Cl_2$, 21% $CH_3OH$, 5% $H_2O$, 0.7% $H_3PO_4$, 0.1% 1,3-dinitrobenzene, 0.1% urea, 0.1% $HCOOCH_3$

III

72% $CCL_3CF_3$, 22% $CH_3OH$, 4.5% $H_2O$, 0.8% $H_3PO_4$, 0.2% urea, 0.2% 1,3-dinitrobenzene, 0.1% $HCOOCH_3$

IV

70% $CH_3CCl_3$, 24.5% $C_2H_5OH$, 4% $H_2O$, 0.7%, $H_3PO_4$, 0.1% dimethylurea, 0.1% 2,4-dinitrotoluene, 0.6% $HCOOCH_3$

V

35% $CH_2Cl_2$, 36% $CCL_3CF_3$, 20% $CH_3OH$, 4% i-$C_3H_7OH$, 4.0% $H_2O$, 0.6% $H_3PO_4$, 0.1% 2,4-dinitrotoluene, 0.1% urea, 0.2% $HCOOCH_3$.

Typically, workpieces comprise surfaces of iron, e.g., steel as well as zinc, manganese and aluminum.

Unless indicated otherwise herein, all details of the process of this invention are conventional, e.g., as disclosed in DAS 2 611 790 and European patent Application 34,842, whose disclosure is incorporated by reference herein.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

The test workpieces employed in the examples are low-carbon, cold-rolled deep-drawn metal sheets St 1405, 10×20 cm in dimension. These sheets are steam-degreased or dip-degreased with commercial metal degreasing baths. Two series of steel sheets are utilized, denoted by A and B, differing only by their surface roughness. Series B has the greater roughness. These test sheets, after degreasing, are weighed in the dry condition and thereafter subjected to phosphating. The phosphating baths selected are those having dichloromethane as the basic solvent, although phosphating baths with other low-boiling halogenated hydrocarbons, or mixtures thereof, are likewise suitable, in principle.

The phosphating vessel is a heatable, jacketed container filled to one-half with phosphating solution and equipped at the upper vessel rim with cooling coils and being somewhat narrowed, in order to avoid evaporation losses. The cooling medium is maintained at −10° C. The vessel can additionally be provided with a lid having a cutout for a suspension means for the sheets.

EXAMPLE 1

The phosphating bath indicated in Table 1 is maintained at boiling in a half-filled jacketed vessel of the above-described type, so that the space up to the cooling coils consists of a gaseous phase in equilibrium with the liquid phase. The prepared test sheets are then suspended in the gaseous phase for preheating until there is no longer any runoff of condensate. Subsequently the test sheets are dipped into the liquid phase and left in the boiling liquid phase for phosphating purposes for a specific period of time (see Table 1). Thereafter the test sheets are again suspended in the gaseous phase for a certain time (see Table 1). During this suspension interval, the excess phosphating solution drips off, and the residual phosphating bath film, in equilibrium with the gaseous phase, acts on the metallic surface. This procedure is repeated once or twice (see Table 1). Then, the sheet is lifted through the cooling zone into the atmosphere, during which step it is immediately dried.

The sheets, after determining the increase in mass, are subjected to test painting in a way usual during the manufacturing process. In principle, all commercial varnish systems can be utilized for the test painting. In this case, a baking enamel based on an alkyd resin is employed which, after the coating step, is baked at 100° C. for 6 minutes. The dry paint layers have a uniform thickness of about 30 μm.

The thus-varnished sheets are subjected, after scratching the surface, to a 240-hour salt spray mist test in accordance with DIN 50 021 and 53 167, and then the extent of hidden rust is determined, and the crisscross cut test is conducted according to DIN 53 151.

The process steps and the test results are set forth in Table 1.

The results demonstrate that, unexpectedly, in spite of the same total dipping period, the layer thickness of the phosphate coat increases with the number of dipping steps, and a marked improvement of corrosion protection is achieved, as proven by salt spray mist test and crisscross cut test.

TABLE 1

Various Phosphating Techniques and Their Results

| Phosphating and Testing Methods | | Data and Results | | |
|---|---|---|---|---|
| Phosphating Bath | | 78.2% $CH_2Cl_2$; 17.2% $CH_3OH$; 4.0% $H_2O$; 0.5% $H_3PO_4$; 0.1% 2,4-Dinitrotoluene | | |
| | | A | | |
| Steel Sheet Series 10 × 20 cm | | For Comparison | According to Invention | |
| Preheating Period in Gaseous Phase | (sec) | 120 | 120 | 120 |
| Dipping Period 1 | (sec) | 60 | 30 | 20 |
| Interval in Gaseous Phase 1 | (sec) | 120 | 120 | 120 |
| Dipping Period 2 | (sec) | | 30 | 20 |
| Interval in Gaseous Phase 2 | (sec) | | 120 | 120 |
| Dipping Period 3 | (sec) | | | 20 |
| Interval in Gaseous Phase 3 | (sec) | | | 120 |
| Total Dipping Period | (sec) | 60 | 60 | 60 |
| Average Mass Increase (mg/m²) | | 790 | 900 | 980 |
| Varnish Structure for Testing | | Baking Enamel Based on Alkyd Resin, One Layer, 30 μm | | |
| DIN Salt Spray Mist Test Average Range of Hidden Rust after 240 Hours | (mm) | 3.1 | 2.3 | 2.0 |
| DIN Crisscross Cut Test | | Gt 3 | Gt 2 | Gt 2 |

EXAMPLE 2

Analogously to Example 1, test sheets are phosphated with the phosphating bath indicated in Table 2, with differing dipping periods in the liquid phase and suspension periods in the gaseous phase. For quality control of the thus-produced phosphate layers, a test paint using a baking enamel based on an alkyd resin is utilized, baked after the coating step for 6 minutes at 100° C. The dry varnish coats have a uniform thickness of about 30 μm.

The process steps and test results are listed in Table 2.

The results show that, in spite of the same dipping time, the layer thickness of the phosphate coat increases considerably with the number of dipping steps, and the corrosion-protective properties are markedly improved with multiple dippings. The greater increase as compared with Example 1 can be traced back to the presence of the formic acid ester. It can also be clearly seen, as compared with Example 1, that in case of multiple dippings the presence of the formic acid ester has a positive effect on the corrosion-protective properties.

TABLE 2

| Various Phosphating Techniques and Their Results | | | | | |
|---|---|---|---|---|---|
| Phosphating and Testing Methods | | Data and Results | | | |
| Phosphating Bath | | 73.5% $CH_2Cl_2$; 20.3% $CH_3OH$; 5.0% $H_2O$; 0.7% $H_3PO_4$; 0.1% 2,4-Dinitrotoluene; 0.3% $HCOOCH_3$ | | | |
| | | A | | B | |
| Steel Sheet Series 10 × 20 cm | | For Comp. | Acc. to Invention | For Comp. | Acc. to Invention |
| Preheating Period in Gaseous Phase | (sec) | 90 | 90 | 90 | 90 |
| Dipping Period 1 | (sec) | 60 | 30 | 60 | 30 |
| Interval in Gaseous Phase 1 | (sec) | | 90 | 90 | 90 |
| Dipping Period 2 | (sec) | | 30 | | 30 |
| Interval in Gaseous Phase 2 | (sec) | | 90 | | 90 |
| Dipping Period 3 | (sec) | | | | |
| Interval in Gaseous Phase 3 | (sec) | | | | |
| Total Dipping Period | (sec) | 60 | 60 | 60 | 60 |
| Average Mass Increase (mg/m$^2$) | | 1,090 | 1,500 | 1,410 | 1,710 |
| Varnish Structure for Testing | | Baking Enamel Based on Alkyd Resin, One Layer, 30 μm | | | |
| DIN Salt Spray Mist Test Average Range of Hidden Rust after 240 Hours | (mm) | 2.5 | 1.5 | 2.2 | 1.5 |
| DIN Crisscross Cut Test | | Gt 2 | Gt 1 | Gt 2 | Gt 1 |

EXAMPLE 3

Using the phosphating baths set forth in Table 3, test sheets are phosphated analogously to Example 1 with differing dipping periods in the liquid phase and hanging periods in the gaseous phase. For quality control of the thus-produced phosphate layers, a test paint is used with a baking enamel based on saturated polyester resins, baked after the coating step for 20 minutes at 150° C. The dry paint layers have a uniform thickness of about 30 μm.

The process steps and test results are indicated in Table 3.

The results demonstrate that by using the multiple dipping method according to this invention, the corrosion-protective properties of the phosphated sheets are appreciably improved, in a completely surprising fashion.

TABLE 3

| Various Phosphating Techniques and Their Results | | | | | | | | | | | | | | |
|---|---|---|---|---|---|---|---|---|---|---|---|---|---|---|
| Phosphating and Testing Methods | | Data and Results | | | | | | | | | | | | |
| Phosphating Bath | | 73.8% $CH_2Cl_2$; 20.0% $CH_3OH$; 5.0% $H_2O$; 0.7% $H_3PO_4$; 0.1% Urea; 0.1% 1,3-Dinitrobenzene; 0.3% $HCOOCH_3$ | | | | | | 73.5% $CH_2Cl_2$; 20.5% $CH_3OH$; 4.8% $H_2O$; 0.7% $H_3PO_4$; 0.1% Urea; 0.1% 2,4-Dinitrotoluene; 0.3% $HCOOCH_3$ | | | | | | |
| | | | | B | | | | | | | B | | | |
| Steel Sheet Series 10 + 20 cm | | Cp. | | In. | Cp. | In. | | Cp. | In. | Cp. | | In. | Cp. | In. |
| Preheating Period in Gaseous Phase | (sec) | 120 | 120 | 120 | 90 | 90 | 90 | 60 | 60 | 90 | 90 | 90 | 90 | 90 |
| Dipping Period 1 | (sec) | 30 | 60 | 10 | 20 | 20 | 20 | 60 | 20 | 30 | 60 | 10 | 40 | 20 |
| Interval in Gaseous Phase 1 | (sec) | 120 | 120 | 120 | | 90 | 90 | 60 | 60 | 90 | 90 | 90 | 90 | 90 |
| Dipping Period 2 | (sec) | | | 10 | | 20 | 20 | | 20 | | | 10 | | 20 |
| Interval in Gaseous Phase 2 | (sec) | | | 120 | | | 90 | | 60 | | | 90 | | 90 |
| Dipping Period 3 | (sec) | | | 10 | | | 20 | | 20 | | | 10 | | |
| Interval in Gaseous Phase 3 | (sec) | | | 120 | | | 90 | | 60 | | | 90 | | |
| Total Dipping Period | (sec) | 30 | 60 | 30 | 20 | 40 | 60 | 60 | 60 | 30 | 60 | 30 | 40 | 40 |
| Average Mass Increase (mg/m$^2$) | | 1200 | 1860 | 1560 | 930 | 1650 | 2170 | 1630 | 2030 | 980 | 1290 | 1340 | 1110 | 1330 |
| Varnish Structure | | Baking Enamel Based on Saturated Polyester Resins, One Layer, 30 μm | | | | | | | | | | | | |
| DIN Salt Spray Mist Test Average Range of Hidden Rust after 240 Hours | (mm) | 4.0 | 3.0 | 1.8 | 5.0 | 2.5 | 0.5 | 3.5 | 0.7 | 4.5 | 3.3 | 1.8 | 3.8 | 2.0 |
| DIN Crisscross Cut Test | | Gt 5 | Gt 3 | Gt 2 | | | Gt 1 | | | | | | | |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for phosphating a metallic surface of an article in a phosphating bath which comprises effective amounts of a low-boiling halogenated hydrocarbon, aqueous phosphoric acid, an alcohol and, optionally, a stabilizer, phosphating regulator or accelerator, comprising at least twice dipping the surface to be phosphated, for at least 10 seconds each time, into said bath under boiling conditions, the surface being at essentially the same temperature as that of the vapor from the boiling bath, and, in the time interval between dippings, treating the surface for at least 20 seconds in the vapor of the boiling bath.

2. A process of claim 1 further comprising, prior to said dipping treatments, preheating said surface to be phosphated by exposing it to the vapor of the boiling phosphating bath.

3. A process of claim 1 wherein the length of each dipping treatment is 10–60 seconds.

4. A process of claim 1 wherein the length of each dipping treatment is 20–30 seconds.

5. A process of claim 3 wherein the length of each intermediate treatment in the vapor between dippings is 20–120 seconds.

6. A process of claim 4 wherein the length of each intermediate treatment in the vapor between dippings is 30–90 seconds.

7. A process of claim 1 wherein the surface is dipped in the bath three times.

8. A process of claim 1 wherein the total length of time that the surface is dipped in the bath is 30–90 seconds.

9. A process of claim 6 wherein the total length of time that the surface is dipped in the bath is 30–60 seconds.

10. A process of claim 1 wherein the total dipping time is at least 30 seconds.

11. A process of claim 1 wherein the length of time the workpiece is suspended in the gaseous phase, between the dipping steps, in each case is at least 30 seconds.

12. A process of claim 1 wherein the phosphating bath further comprises a formic acid ester of a $C_{1-12}$-alkanol as an activating component and methanol or an alkanol mixture comprising predominantly methanol as the solubilizer.

13. A process of claim 1 wherein the alcohol is a $C_{1-12}$-alkanol.

14. A process of claim 1 wherein the bath comprises a stabilizer, oxidation inhibitor and accelerator.

15. A process of claim 1 wherein the boiling point of the bath is about 40° C.

16. A process of claim 1 wherein the halogenated hydrocarbon is dichloromethane, chloroform, trichlorotrifluoromethane, dichloroethane, trichloroethylene, 1,1,1-trichloroethane, 1,1,3-trichlorotrifluoroethane, or a mixture thereof.

17. A process of claim 1 wherein the alcohol solubilizer is methanol or an alkanol mixture comprising predominantly methanol.

18. A process of claim 1 comprising 60–85 wt % of halogenated hydrocarbon, 0.1–2.0% of $H_3PO_4$, 0.5–7 wt % of water, 10–30% by weight of alcohol, and, optionally, 0.01–1.0 wt % of each of an accelerator, a stabilizer or an oxidation inhibitor or 0.01–2.0 wt % of a formic acid ester of a $C_{1-12}$-alkanol.

19. A process of claim 1 comprising 70–80 wt % of halogenated hydrocarbon, 0.3–1.0% of $H_3PO_4$, 3.0–6.0 wt % of water, 15–25% by weight of alcohol, and, optionally, 0.05–0.3 wt % of each of an accelerator, a stabilizer or an oxidation inhibitor or 0.1–1.0 wt % of a formic acid ester of a $C_{1-12}$-alkanol.

20. A process for varnishing a metallic surface comprising phosphating the surface in accordance with the process of claim 1, drying the surface and then varnishing the surface.

* * * * *